US005980693A

United States Patent [19]

Liang et al.

[11] Patent Number: 5,980,693

[45] Date of Patent: Nov. 9, 1999

[54] EXTENDED NIP PRESS APPARATUS

[75] Inventors: Shihua Liang; David McCarville, both of Roscoe, Ill.; David Lange, Beloit, Wis.

[73] Assignee: Beloit Technologies, Inc., Wilmington, Del.

[21] Appl. No.: 09/048,440

[22] Filed: Mar. 26, 1998

[51] Int. Cl.[6] ..... D21F 3/06

[52] U.S. Cl. ..... 162/358.3; 162/358.5

[58] Field of Search ..... 162/358.3, 358.5, 162/361, 205; 100/153

[56] References Cited

U.S. PATENT DOCUMENTS

| | | | |
|---|---|---|---|
| 3,564,631 | 2/1971 | Burling | 8/156 |
| 3,970,515 | 7/1976 | Busker | 162/360 |
| 4,464,226 | 8/1984 | Karvinen | 162/358 |
| 4,468,287 | 8/1984 | Dahl | 162/358 |
| 4,506,456 | 3/1985 | Lehtinen | 34/12 |
| 4,518,460 | 5/1985 | Hauser et al. | 162/361 |
| 5,071,513 | 12/1991 | Bluhm et al. | 162/358.5 |
| 5,645,691 | 7/1997 | Zuefle et al. | 162/358.3 |

FOREIGN PATENT DOCUMENTS

| | | | |
|---|---|---|---|
| 218918 | 12/1982 | Germany . | |
| 3224007 | 12/1983 | Germany | 162/358.3 |
| 929773 | 5/1982 | U.S.S.R. . | |

*Primary Examiner*—Karen M. Hastings
*Attorney, Agent, or Firm*—Lathrop & Clark LLP

[57] ABSTRACT

An extended nip press apparatus is disclosed for pressing a web of paper extending therethrough. The apparatus includes a rotatable backing roll and a press shoe having a concave surface which cooperates with the backing roll. The arrangement is such that the concave surface and the backing roll define therebetween an elongated pressing section for the passage therethrough of the web. The shoe includes an upstream portion and a device for urging the upstream portion toward the backing roll. A downstream portion extends from the upstream portion, the downstream portion being resiliently disposed relative to the upstream portion. A further device selectively urges the downstream portion toward the backing roll for controlling a pressure profile applied by the shoe to the web for inhibiting delamination of the web.

9 Claims, 3 Drawing Sheets

EXTENDED NIP PRESS APPARATUS

BACKGROUND OF THE INVENTION

FIELD OF THE INVENTION

The present invention relates to an extended nip press apparatus for pressing a web of paper extending therethrough.

More specifically, the present invention relates to an improved heated extended nip press apparatus.

INFORMATION DISCLOSURE STATEMENT

A formed web of paper transferred from a forming section includes a considerable quantity of water therein. Accordingly, a large portion of that water is removed by pressing the web between a pair of counter rotating rolls.

More recently, extended nip presses have been employed in which a shoe having a concave surface cooperates with a rotatable backing roll. The arrangement is such that the web carried by a moving blanket extends through the elongate pressing section defined between the concave surface and the backing roll. Such extended nip arrangements apply a more gradual and controlled removal of the water from the web because the residence time of the web within the pressing section is greater than the corresponding residence time in a roll couple press.

With the extended nip press arrangement, considerable effort has been employed in the application of heat to the backing roll in order to further increase the water removing capabilities of the extended nip press apparatus.

More specifically, by the application of heat for an extended period of time, more water is able to be removed during travel of the web through the elongated pressing section.

However, particularly in the production of board grades, a problem has been experienced in the aforementioned high temperature pressing technique in that there exists a tendency for the pressed board to delaminate when exiting from the elongated pressing section.

Such delamination may be caused by the sudden release of pressure on the web when the web leaves the pressing section. The present invention overcomes the aforementioned problem by gradually and controllably releasing the pressure applied to the web.

Therefore, it is a primary objective of the present invention to provide an extended nip press apparatus that overcomes the aforementioned inadequacies of the prior art arrangements and which makes a consideration contribution to the web pressing art. The benefits derived from the use of a heated ENP according to the present invention include the removal of more water from the web, the production of a web having improved paper properties and an energy saving.

Also, by using an ENP according to the present invention, delamination is avoided, additional dryness of the web is achieved and rewet of the web is avoided.

Other objects and advantages of the present invention will be readily apparent to those skilled in the art by consideration of the detailed description contained hereinafter taken in conjunction with the annexed drawings.

SUMMARY OF THE INVENTION

The present invention relates to an extended nip press apparatus for pressing a web of paper extending therethrough. The apparatus includes a rotatable backing roll and a press shoe having a concave surface which cooperates with the backing roll. The arrangement is such that the concave surface and the backing roll define therebetween an elongated pressing section for the passage therethrough of the web. The shoe includes an upstream portion and means for urging the upstream portion towards the backing roll.

A downstream portion of the shoe extends from the upstream portion, the downstream portion being resiliently disposed relative to the upstream portion.

A further means selectively urges the downstream portion of the shoe towards the backing roll for controlling a pressure profile applied by the shoe to the web for inhibiting delamination of the web.

In a more specific embodiment of the present invention, the apparatus further includes heating means for heating the backing roll.

More specifically, the heating means is an induction heater and the press shoe is a hydrodynamic shoe.

The upstream portion and the downstream portion together define the concave surface.

The means for urging the upstream portion includes a cylinder and a piston slidably disposed within the cylinder.

The downstream portion is thinner than the upstream portion so that the downstream portion is more resilient relative to the backing roll than the upstream portion.

In a preferred embodiment of the present invention, a further means for urging the downstream portion includes a pneumatically loaded tube which is connected to a source of pressurized air. The arrangement is such that when the tube is controllably connected to the source of pressurized air, the downstream portion is selectively urged toward the backing roll in order to generate a differential pressure in a machine direction. The pressure between the upstream portion and the backing roll is greater than a pressure between the downstream portion and the backing roll so that when the web extends through the pressing section, any tendency for the web to delaminate when departing from the upstream portion is controlled by the pressure exerted on the web between the downstream portion and the backing roll.

Many modifications and variations of the present invention will be readily apparent to those skilled in the art by consideration of the detailed description contained hereinafter taken in conjunction with the annexed drawings. However, such modifications and variations fall within the spirit and scope of the present invention as defined by the appended claims. Included in such modifications would be the use of a hydraulic loaded means rather than a pneumatic loaded tube. Also, although a hydrodynamic shoe has been shown in the preferred embodiment, the invention is equally applicable to a hydrostatic shoe arrangement. Furthermore, the present invention is able to be applied to an enclosed shoe arrangement in which the lubricating oil is confined within the enclosed loop of the blanket or with an open blanket arrangement in which the blanket is guided over a plurality of guide rolls. Additionally, although induction heaters are described in the preferred embodiment, those skilled in the art will appreciate that the inventive concept of the present invention is not limited to induction heaters and that heated oil circulating through the backing roll can be employed or a combination of oil heating and induction heating or any other type of heating arrangement.

BRIEF DESCRIPTION OF THE DRAWINGS

Similar reference characters refer to similar parts throughout the various views of the drawings.

DETAILED DESCRIPTION OF THE DRAWINGS

Figure 1:
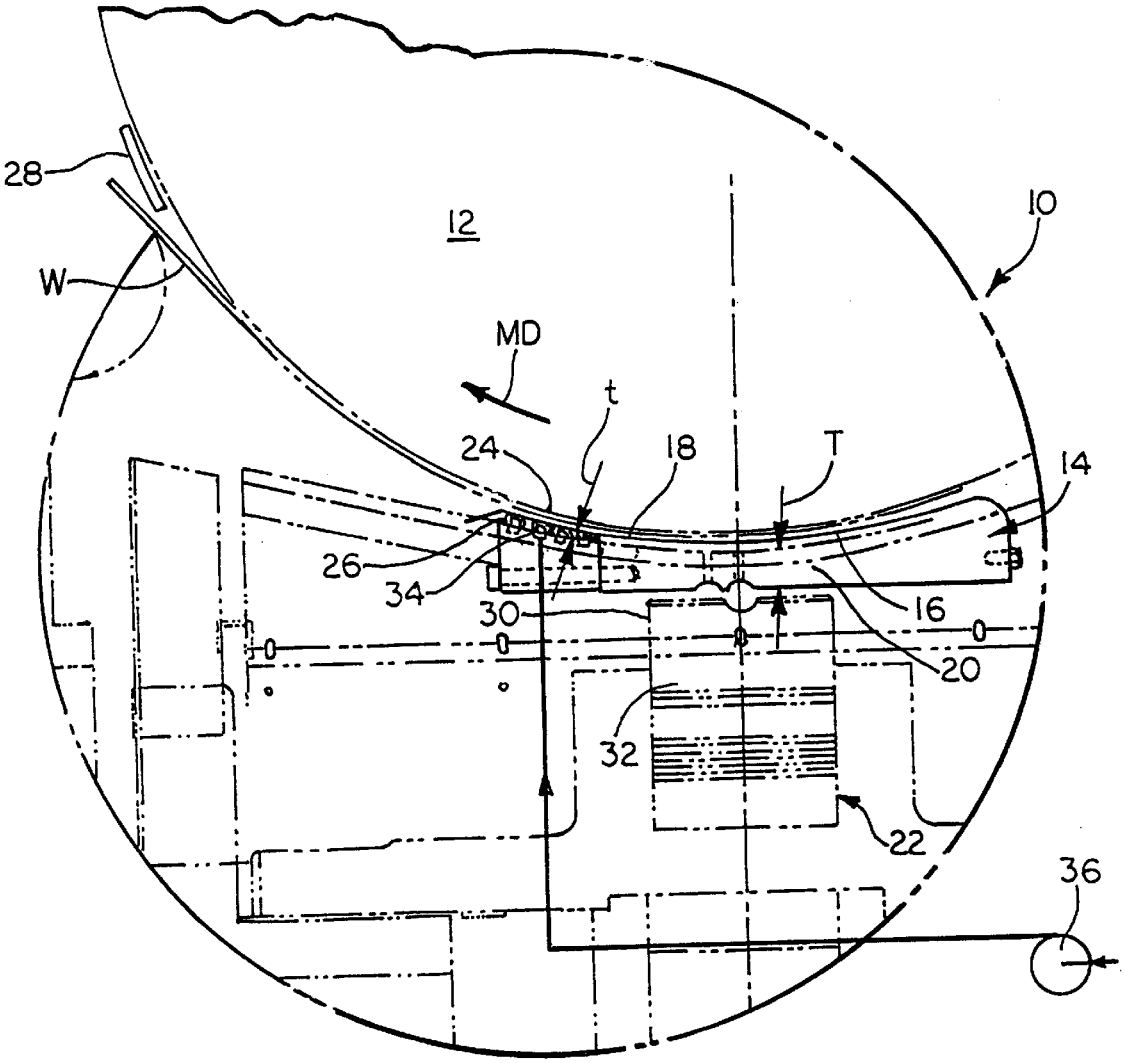
FIG. 1 is a side elevational view of an extended nip press apparatus according to the present invention.

FIG. 1 is a side elevational view of an extended nip press apparatus generally designated 10 according to the present invention for pressing a web of paper W extending therethrough. The apparatus 10 includes a rotatable backing roll 12 and a press shoe generally designated 14 having a concave surface 16 which cooperates with the backing roll 12. The arrangement is such that the concave surface 16 and the backing roll 12 define therebetween an elongated pressing section 1 8 for the passage therethrough of the web W. The shoe 14 includes an upstream portion 20 and means generally designated 22 for urging the upstream portion 20 towards the backing roll 12.

A downstream portion 24 extends from the upstream portion 20 and is resiliently disposed relative to the upstream portion 20.

A further means 26 selectively urges the downstream portion 24 towards the backing roll 12 for controlling a machine direction pressure profile applied by the shoe 14 to the web W for inhibiting delamination of the web W.

As shown in FIG. 1, the extended nip press apparatus 10 also includes heating means 28 for heating the backing roll 12. The heating means specifically is an induction heater.

As shown in FIG. 1, the press shoe 14 is a hydrodynamic shoe.

The upstream and downstream portions 20 and 24 together define the concave surface 1 6 and the means 22 for urging the upstream portion 20 includes a cylinder 30 and a piston 32 which is slidably disposed within the cylinder 30.

The downstream portion 24 has a thickness t and is thinner than the thickness T of the upstream portion 20 so that the downstream portion 24 is more resilient relative to the backing roll 12 than the upstream portion 20.

As shown, the further means 26 for urging the downstream portion 24 includes at least one pneumatically loaded tube 34 which is connected to a source of pressurized air 36. The arrangement is such that the tube 34 is controllably connected to the source of pressurized air 36. The downstream portion 24 is selectively urged towards the backing roll 1 2 in order to generate a differential pressure on the web in the machine direction indicated by the arrow MD. The pressure between the upstream portion 20 and the backing roll 12 is greater than a pressure between the downstream portion 24 and the backing roll 12. Such differential pressure is so that when the web W extends through the pressing section 18, any tendency for the web W to delaminate when departing from the upstream portion 20 is controlled by the pressure exerted on the web W between the downstream portion 24 and the backing roll 12.

Figure 2:
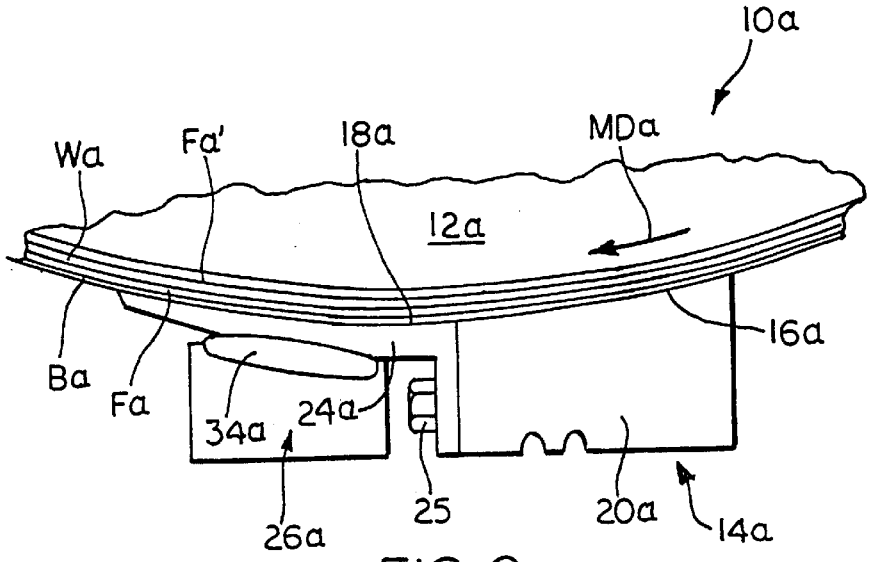
FIG. 2 is a side elevational view of an extended nip press apparatus according to an alternative embodiment of the present invention.

FIG. 2 is a side elevational view of another embodiment of the present invention. FIG. 2 shows an extended nip press apparatus generally designated 10*a* having a hydrodynamic press shoe generally designated 14*a*. The shoe 14*a* includes a concave surface 16*a* which cooperates with a backing roll 12*a*. The arrangement is such that the concave surface 16*a* and the backing roll 12*a* define therebetween an elongate pressing section 18*a* for the passage therethrough of the web Wa. An upstream portion 20*a* is urged towards the backing roll 12*a* by a hydraulic means (not shown).

Figure 3:
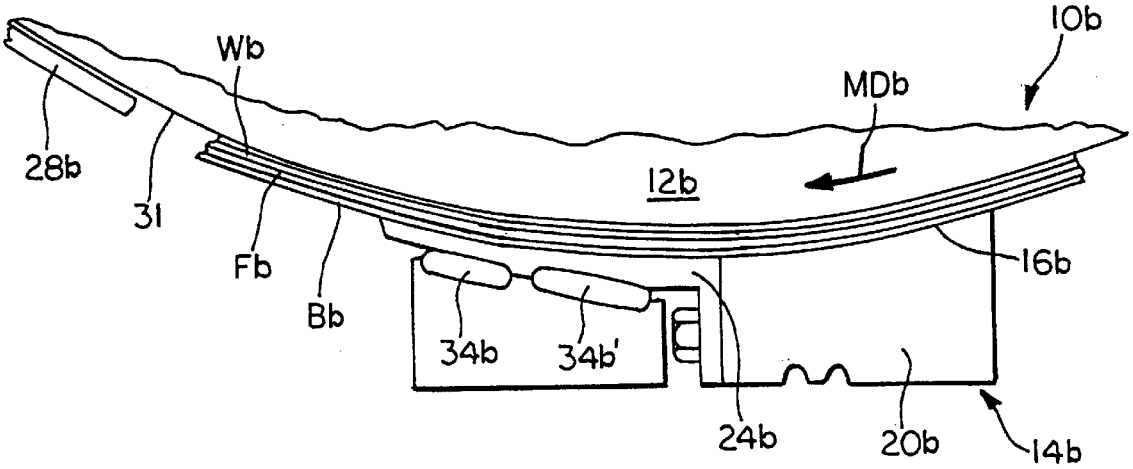
FIG. 3 is a side elevational view of an extended nip press apparatus according to yet a further embodiment of the present invention.

A downstream portion 24*a* extends from the upstream portion 20*a* and is resiliently secured by bolt 25 to the upstream portion 20*a* The downstream portion is cantilevered relative to the upstream portion as can be seen in FIGS. 2 and 3., A further means 26*a* selectively urges the downstream portion 24*a* towards the backing roll 12*a* for controlling a machine direction MDa pressure profile applied by the shoe 14*a* to the web Wa for inhibiting delamination of the web Wa.

As shown in FIG. 2, the press apparatus 10*a* includes a bearing blanket Ba which comes into surface contact with the concave surface 16*a* of the shoe.

Additionally, the web Wa is sandwiched between a felt Fa and a felt $Fa^1$, the felt Fa being disposed adjacent to the blanket Ba.

The downstream portion 24*a* is urged toward the roll 12*a* by means of a single pneumatic tube 34*a*.

FIG. 3 is a side elevational view of yet another embodiment of the present invention. FIG. 3 shows a press apparatus generally designated 10*b* which includes a backing roll 12*b* and a press shoe 14*b* defining a concave surface 16*b* which cooperates with the backing roll 12*b*.

The shoe 14*b* includes an upstream portion 20*b* and a downstream portion 24*b*. The downstream portion 24*b* is urged towards the backing roll 12*b* by means of pneumatically inflatable tubes 34*b* and 34*b*$^{1.}$ As shown in FIG. 3, the bearing blanket Bb carries a felt Fb and the web Wb through the pressing section with the felt Fb disposed between the web Wb and the bearing blanket Bb so that the web Wb comes into direct surface contact with the heated surface 31 of the backing roll 12*b*. The surface 31 is heated by means of induction heater 28*b*.

Figure 4:
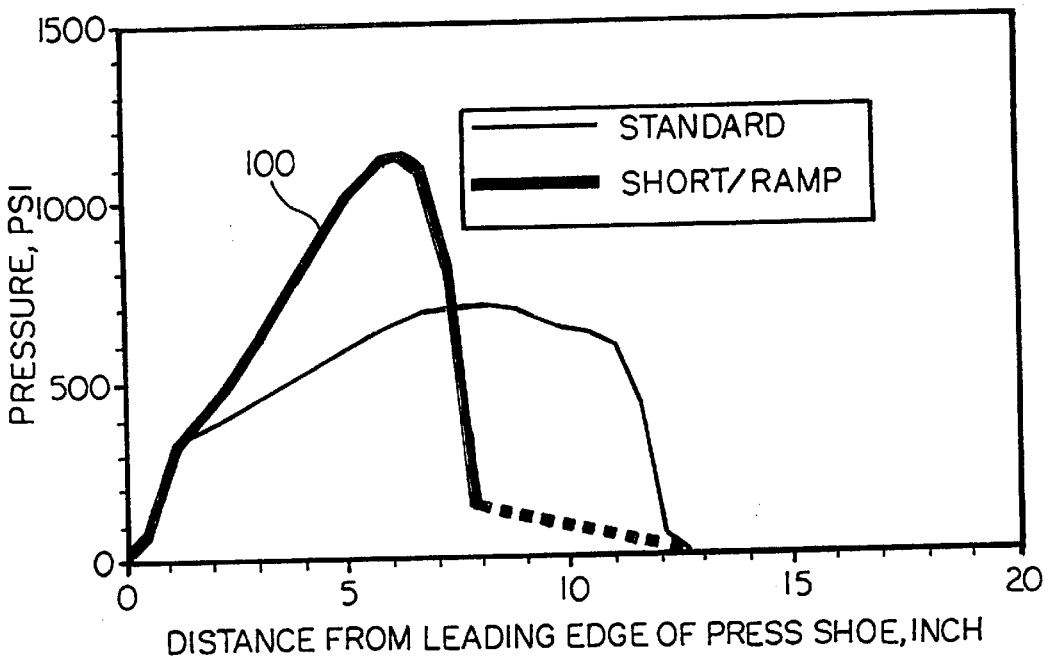
FIG. 4 is a graph showing the improved pressure profile achieved using the apparatus according to the present invention compared with a standard prior art profile.

FIG. 4 is a graph showing the pressure profile 100 achieved using the apparatus according to the present invention when compared with a standard pressure profile. The graph shows the pressure applied relative to the distance in inches from the leading edge of the press shoe.

Figure 5:
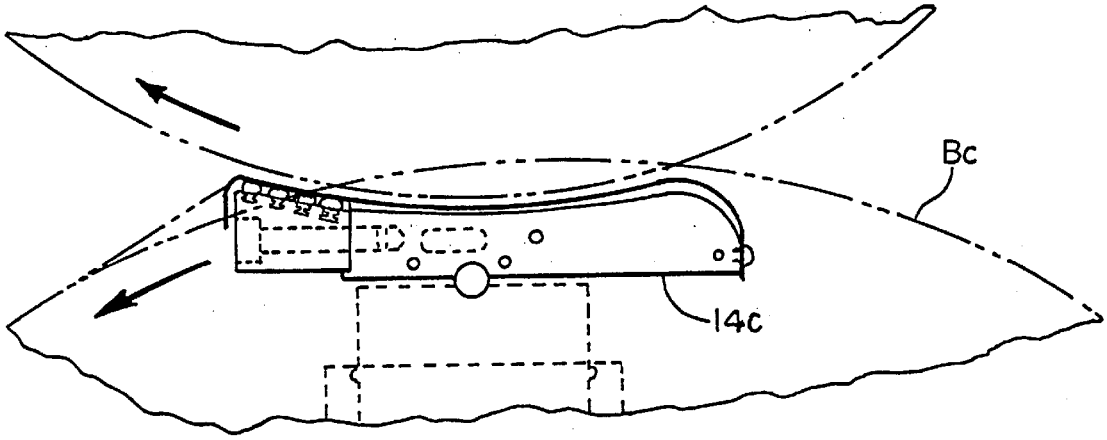
FIG. 5 is a similar view to that shown in FIG. 1 but shows the present invention applied to an enclosed ENP.

FIG. 5 is a similar view to that shown in FIG. 1 but shows a shoe 14*c* disposed within an enclosed ENP in which a bearing blanket $B_c$ encloses the shoe 14*c*.

In operation of the apparatus as shown in FIGS. 1–3 and 5, it should be borne in mind that impulse drying takes place when a wet paper web and felt pass through a press nip of a pair of rolls or a roll and a shoe. One of the surfaces in the nip is heated to a high temperature to improve web dryness and paper properties. It has been demonstrated that impulse drying or high temperature pressing not only results in energy savings, but also enhances paper surface fiber conformability and interfiber bonding.

However, one problem with the use of impulse drying is that there is a tendency for the paper web to delaminate, especially when heavy weight paper grades are being pressed. The aforementioned problem has been the major obstacle to the commercialization of impulse drying.

Studies have led to an explanation of the delamination phenomena. Generally, it is understood that when a paper web leaves a loaded nip, the pressure exerted on the web comes to a rapid drop. Such nip pressure reduction may result in evaporation in the heated fluid inside the web. Due to the paper web resistance to the flow of vapor, high vapor pressure may be produced. When the vapor pressure inside the web is increased to a point where the web structure fails, the web delaminates.

In order to minimize the problem of delamination, the present invention seeks to slow down the nip pressure release process. By this means, the vapor is given a longer time to escape. Additionally, the extended pressure also provides a support to the web during the evaporation process.

In the present invention, the extension is flexibly connected to the upstream portion of the shoe and uses an inflatable tube to control the post-nip pressure. The loading tube and a properly designed thickness of the extension provides a desired post-nip pressure profile under a wide range of press loading conditions. The aforementioned design also allows an operator to adjust the post-nip pressure during the run without changing the loading on the shoe. A certain thickness profile may be required to achieve an optimized pressure profile.

Depending on the length of the extension and the desired post-nip pressure profile, a single tube or as shown in FIG. 3, a multiple tube arrangement can be utilized.

The present invention provides a unique arrangement for inhibiting delamination particularly in a heated extended nip press apparatus.

What is claimed is:

1. An extended nip press apparatus for pressing a web of paper traveling therethrough, said apparatus comprising:

a rotatable backing roll;

a press shoe having a concave surface which cooperates with said backing roll, the arrangement being such that said concave surface and said backing roll define therebetween an elongated pressing section for the passage therethrough of the web;

said concave surface of said shoe including:

an upstream portion with respect to the direction of web travel;

means for urging said upstream portion toward said backing roll;

a downstream portion extending from said upstream portion, said downstream portion being resiliently disposed relative to said upstream portion and said downstream portion being more resilient than said upstream portion; and further means for selectively urging said downstream portion toward said backing roll for controlling a pressure profile applied by said shoe to the web and effective for inhibiting delamination of the web as the web departs from said upstream portion.

2. An extended nip press apparatus as set forth in claim 1, further including:

heating means for heating said backing roll.

3. An extended nip press apparatus as set forth in claim 2, wherein said heating means is an induction heater.

4. An extended nip press apparatus as set forth in claim 1, wherein said press shoe is a hydrodynamic shoe.

5. An extended nip press apparatus as set forth in claim 1, wherein said means for urging said upstream portion includes:

a hydraulic piston which slides within a cylinder;

a cylinder;

a hydraulic piston slidably disposed within said cylinder.

6. An extended nip press apparatus as set forth in claim 1, wherein said downstream portion is thinner than said upstream portion so that said downstream portion is more resilient relative to said backing roll than said upstream portion.

7. An extended nip press apparatus as set forth in claim 1, wherein:

said further means for urging said downstream portion includes:

a pneumatically loaded tube connected to a source of pressurized air, the arrangement being such that when said tube is controllably connected to said source of pressurized air, said downstream portion is selectively urged towards said backing roll in order to generate a differential pressure in a machine direction, the pressure between said upstream portion and said backing roll being greater than the pressure between said downstream portion and said backing roll, so that when the web travels through said pressing section, any tendency for the web to delaminate when departing from said upstream portion is controlled by said pressure exerted on the web between said downstream portion and said backing roll.

8. An extended nip press apparatus for pressing a web of paper traveling therethrough, said apparatus comprising:

a rotatable backing roll;

a press shoe having a concave surface which cooperates with said backing roll, the arrangement being such that said concave surface and said backing roll define therebetween an elongated pressing section for the passage therethrough of the web;

said concave surface of said shoe including:

an upstream portion with respect to the direction of web travel, having an upstream and a downstream end;

means for urging said upstream portion toward said backing roll;

a cover having an upstream and a downstream extremity, said cover being anchored to said upstream portion adjacent to said upstream end;

said downstream extremity extending downstream past said downstream end of said upstream portion for defining a downstream portion;

said downstream portion being resiliently disposed relative to said upstream portion and said downstream portion being more resilient than said upstream portion; and further means for selectively urging said downstream portion toward said backing roll for controlling a pressure profile applied by said shoe to the web and effective for inhibiting delamination of the web as the web departs from said upstream portion.

9. An extended nip press apparatus for pressing a web of paper traveling therethrough, said apparatus comprising:

a rotatable backing roll;

a press shoe having a concave surface which cooperates with said backing roll, the arrangement being such that said concave surface and said backing roll define therebetween an elongated pressing section for the passage therethrough of the web;

said concave surface of said shoe including;

an upstream portion with respect to the direction of web travel;

means for urging said upstream portion toward said backing roll;

a downstream portion extending from said upstream portion, said downstream portion being cantilevered relative to said upstream portion and said downstream portion being more resilient than said upstream portion; and further means for selectively urging said downstream portion toward said backing roll for controlling a machine direction pressure profile applied by said shoe to the web and effective for inhibiting delamination of the web as the web departs from said upstream portion.

* * * * *